US007228671B1

(12) United States Patent
McCarten

(10) Patent No.: US 7,228,671 B1
(45) Date of Patent: Jun. 12, 2007

(54) TOP-DOWN METHOD OF ASSEMBLING DOME STRUCTURES

(76) Inventor: James D. McCarten, 20235 Whaleshead Rd., Brookings, OR (US) 97415

( * ) Notice: Subject to any disclaimer, the term of this patent is extended or adjusted under 35 U.S.C. 154(b) by 0 days.

(21) Appl. No.: 11/200,346

(22) Filed: Aug. 8, 2005

Related U.S. Application Data

(62) Division of application No. 09/557,693, filed on Apr. 25, 2000, now abandoned.

(51) Int. Cl.
*E04H 12/00* (2006.01)

(52) U.S. Cl. ..... 52/653.1; 52/125.6; 52/81.1; 52/745.03

(58) Field of Classification Search ..... 52/123.1, 52/125.6, 81.1, 81.2, 745.03, 745.17, 745.18, 52/653.1
See application file for complete search history.

(56) References Cited

U.S. PATENT DOCUMENTS 1,605,472 A * 11/1926 Schick ..... 52/116
2,857,026 A * 10/1958 Jones ..... 52/123.1
3,026,651 A * 3/1962 Richter ..... 52/81.4
3,248,831 A * 5/1966 Jones ..... 52/121
3,331,168 A * 7/1967 Frey ..... 52/73
3,638,806 A * 2/1972 Hippach ..... 212/231
3,857,212 A * 12/1974 Barnett ..... 52/81.3
4,680,901 A * 7/1987 Armitage ..... 52/81.4
4,703,594 A * 11/1987 Reber ..... 52/81.3
6,430,892 B1 * 8/2002 Castano ..... 52/745.08

* cited by examiner

*Primary Examiner*—Carl D. Friedman
*Assistant Examiner*—Basil Katcheves
(74) *Attorney, Agent, or Firm*—Craig M. Stainbrook; Stainbrook & Stainbrook, LLP

(57) ABSTRACT

A strutless building module comprising a polygon having a plurality of inclined faces that converge at the module center, said module center having a center connector, said module further having sides that angle downwardly from their respective module faces and including a plurality of insertion holes passing entirely through the side, wherein adjoining modules may be connected by placing modules side-to-side and passing bolts through aligned insertion holes. The modules have an elevated center formed at the convergence of the inclined module faces. The method of assembling the inventive modules into a dome structure comprises erecting a boom-free hoist at the intended center of the dome, said hoist having a winch and cable apparatus; connecting an array of modules into a first lift; connecting said cable apparatus to the center connectors of each module; elevating the first lift; connecting modules to the underside of the modules comprising the first lift; and thereafter repeating this process until the desired dome is completed.

5 Claims, 8 Drawing Sheets

TOP-DOWN METHOD OF ASSEMBLING DOME STRUCTURES

CROSS REFERENCE TO RELATED APPLICATIONS

The present application is a divisional application of U.S. patent application Ser. No. 09/557,693, filed Apr. 25, 2000 (Apr. 25, 2000), now abandoned.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to geodesic domes, and more particularly to a strutless polygonal building module having a center connecting device adapted to an efficient top-down method of assembling a plurality of said modules into a domical structure using a boom-free pole hoist.

BACKGROUND INFORMATION AND DISCUSSION OF RELATED ART

The geodesic dome has long been used as the basic design principle in a number of structures, including both permanent and portable structures. Its modular design allows for the transportation and assembly of large structures on even marginally improved sites. However, the assembly of geodesic domes is not as simple or as streamlined as it might be. Currently, the construction of most large scale geodesic domes require either scaffolding, a supporting framework, a crane, swinging boom or other hoisting equipment, or some combination of this equipment, and the equipment itself requires its own assembly and disassembly. Furthermore, most dome assemblies entail the use of modules requiring a large number of connecting units including, for example, gussets, and connecting hubs and struts for the assembly of the individual triangular module sections or frame-wall sections.

Several solutions have been proposed to simplify and improve the construction of modular structures, including the design disclosed in U.S. Pat. No. 4,092,810 to Sumner, which teaches a domical structure constructed by mating right-hand and left-hand versions of scalene triangular panels. The panels are secured at their overlapping edges to form an integral reinforcing structure that requires no supporting framework. It may be constructed upwardly from its base or downwardly from its top.

U.S. Pat. No. 4,287,690 to Berger, et al discloses a domed structure constructed from flat triangular panels having abutment surfaces at their sides having continuous interengaging means adapted to insertively mate with adjacent panels. It is constructed upwardly from its base.

U.S. Pat. No. 5,732,514 to Organ teaches a domical structure comprising preformed sub panels bent at the proper angles and having a series of flanges around their perimeter to allow the panels to be bolted together. The sub panels are formed into quarter sections that are bolted together in the field, along with floor sections to make a complete structure.

However, none of the foregoing designs or other known prior art disclose building modules, and more particularly a module having a center connecting device, specifically adapted for assembly in the top-down fashion. Additionally, none teaches a module including a disc member for containing wall-finishing materials within each building module prior to assembly into a structure. The present invention includes such structures and therefore represents an improvement over known portable dome structures and methods for constructing such structures.

BRIEF SUMMARY OF THE INVENTION

The strutless building module of the present invention comprises a polygon having a plurality of inclined faces that converge at the module center. At the module center is a center connector comprising an integral center connector bolt and a connector washer held in position over the center connector bolt by a conventional, center-connecting nut.

The building module further includes sides that depend downwardly from associated module faces at an approximate angle of 83 degrees (83°). Adjoining module faces and sides intersect in an upper vertex, and the corresponding adjoining sides further intersect in a lower vertex. Each side has a plurality of insertion holes passing entirely through the side, wherein adjoining modules may be connected by placing modules side to side, upper vertex to upper vertex and lower vertex to lower vertex, and aligning the insertion holes so that an insertion bolt may be placed through the insertion hole and secured with a nut. The modules have an elevated center, which constitutes the convergence of the faces, each of which rises from the face's outer edge at an angle of approximately thirteen degrees (13°). First and second preferred embodiments of the inventive module comprise a pentagon and a hexagon, respectively.

The module optionally includes a disc member, concentric with the center connector washer and similarly held in place by a nut. This disc can be employed to provide increased structural integrity to the module and/or as means for holding insulating material, wallboard, paneling, wall covering, or the like, between the disc and the interior surface of the module. Additionally, if the modules are fabricated from materials suitably transparent for greenhouse house, the disc may be fabricated from transparent material, polarized, and electronically and/or mechanically driven to carefully control the passage of light into the structure. In this fashion, the structure may be converted into a biosphere tailored to the light cycle of certain plant species.

To provide the optimum strength for larger structures, the sides and the intersections of the module faces can be reinforced with a laminated hub-and-spoke configuration. The module may be fabricated from any of a number of suitable materials, including, among others, wire-mesh reinforced concrete, fiberglass, and several lightweight plastics. The geometry of the module lends itself to manufacture using a simple two part mold, making mass production not only possible but economical, rapid, and easily implemented in relatively undeveloped, unindustrialized circumstances.

The inventive strutless modules are connected at their sides by positioning a first module relation to an adjoining second module such that the respective sides of each module are approximated and the insertion holes are aligned. Bolts are inserted through each hole, a washer is placed over each bolt, and a nut is then placed and tightened down onto each bolt.

Also disclosed is a method of assembling the inventive modules. This method comprises a first step of erecting a boom-free hoist in a substantially vertical position such that its base is located at substantially the intended center of the dome structure. The hoist comprises a vertical support member which may be sunk into the ground or otherwise structurally supported. A comealong or ratchet winch is connected to the vertical support member near the base of the hoist using an eye bolt passing through the vertical support member. A cable connected to the winch via a hook passes upwardly to the upper end of the hoist and through a hoist pulley, then downwardly to a terminal heavy hook.

Next, an array of modules is then placed around the base of the hoist, and each of the modules is connected to form what will become the uppermost section of the dome, excluding the topmost module. Connection cables are assembled and connected at their lower ends to a center connecting bolt of one of the modules. The upper ends of the connection cables are connected to the heavy hook.

After connecting the connection cables to the center connectors and the heavy hook, the winch is positively operated to elevate this initial module layer above the ground. Construction continues in lifts as the hoist raises the dome to provide workers with a convenient and comfortable means to connect module after module to the lower sides of assembled modules.

There are numerous practical advantages of the inventive building module and method of assembling the module into a dome structure. Accordingly, it is an object of the present invention to provide a strutless building module that can be manufactured in a simple two part mold.

It is a further object of this invention to provide a building module having a center connecting device that enables the module to be assembled by one or more persons using a simple lifting device, specifically a boom-free hoist, which may be selectively incorporated into the completed structure or removed.

It is a further object of this invention to provide a building module that has substantial structural strength without the need for frame members.

It is yet another object of this invention to provide a building module that may be assembled into a dome structure using common hardware tools.

It is still another object of this invention to provide a building module that can incorporate wall materials, such as insulation, paneling, acoustic tiles or other sound attenuation materials, and the like, before assembly.

It is another object of this invention to provide a center connect module suitable for use in hanging greenhouse plants.

It is a further object of this invention to provide a center connect module adapted for use as a hub when the modules and disc members are transparent to sunlight so as to electronically and/or mechanically rotate polarized discs positioned within the interior center of the module to maintain a consistent and controllable amount of sunlight throughout the day.

It is another object of this invention to provide a top-down method of assembling a dome structure using the inventive strutless building module that exploits the advantages of the module and further provides flexibility in orienting the structure during construction.

Finally, it is an object of this invention to provide a top-down method of assembling a dome structure such that construction activity is almost entirely restricted to working at ground level with a minimum of lifting.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1A:
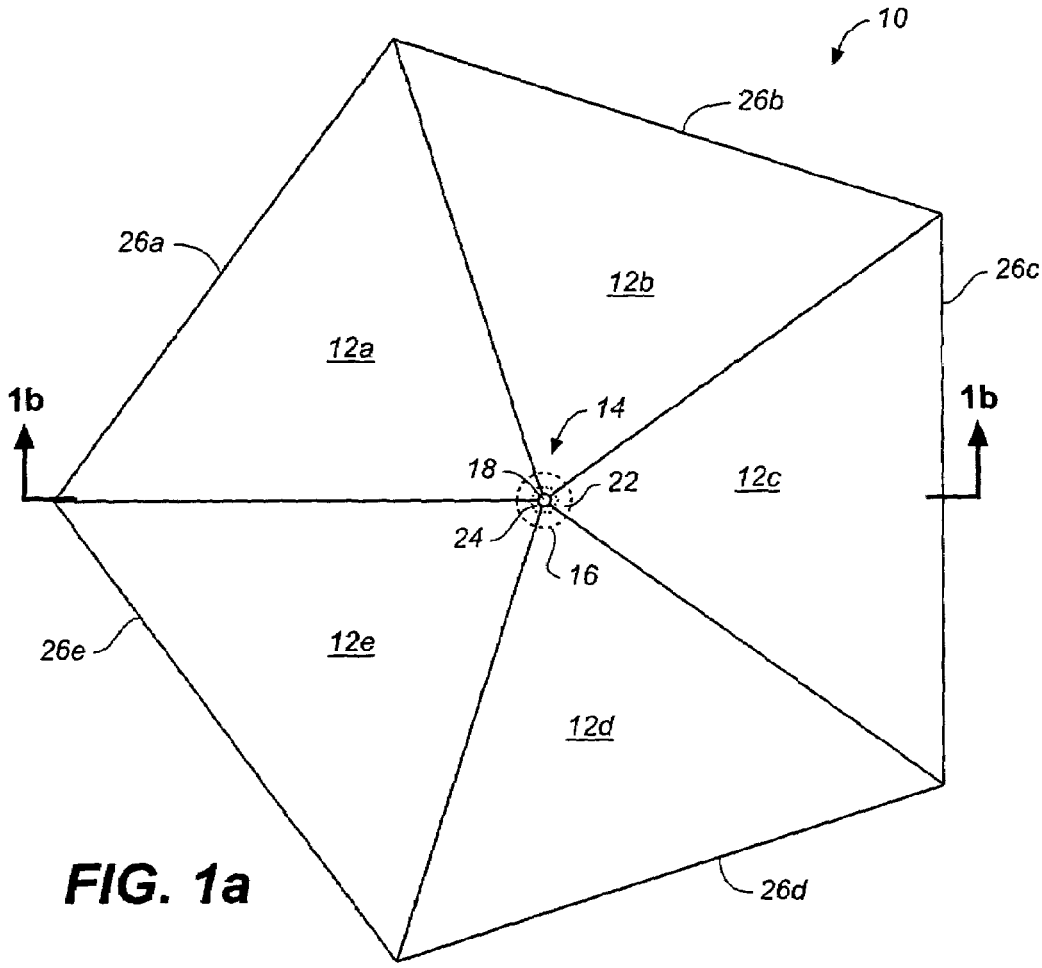
FIG. 1*a* is a top view of the strutless building module of the present invention, showing the module in its pentagonal embodiment.
Figure 1B:
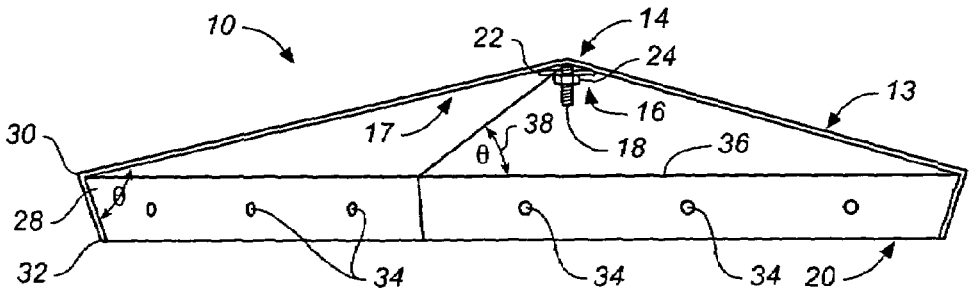
FIG. 1*b* is a side elevation cross-sectional view of the module of FIG. 1*a* viewed along the cutting plane indicated in FIG. 1*a;*

Referring to FIGS. 1 through 8, wherein like reference numerals refer to like components in the various views, there is illustrated therein a new and improved method of constructing dome structures. FIG. 1*a* is a top view of the strutless building module 10 of the present invention, showing the module in its first preferred, pentagonal embodiment. FIG. 1*b* is a side elevation cross-sectional view of the module of FIG. 1*a* viewed along the cutting plane indicated in FIG. 1*a*. In this embodiment, each module has five substantially triangular faces 12, 12*b*, 12*c*, 12*d*, and 12*e*, preferably substantially flat and oriented so as to converge, on the exterior surface of the module 13, at a point substantially at the module center 14. A center connector 16 is positioned on the interior surface of the module 17 substantially at the module center, said connector comprising an integral center connector bolt 18 depending downwardly when the module is laid flat on its interior edge 20. A center connector washer 22 is held positioned over the center connector bolt and held in place by a conventional, center-connector nut 24.

The first preferred embodiment of the building module of the present invention further includes five sides, 26*a* through 26*e*, each of which depends downwardly from it associated module face at an approximate angle 28 of 83 degrees. Adjoining module faces and sides intersect in an upper vertex 30, and the corresponding adjoining side further intersect in a lower vertex 32. Each side has a plurality of insertion holes 34 passing entirely through the side. When adjoining modules are placed side by side, upper vertex to upper vertex and lower vertex to lower vertex, the insertion holes are aligned so that an insertion bolt may be placed through the insertion hole for connection of the modules.

The geometry of the first preferred embodiment is completed by its elevated center, which constitutes the convergence of the faces, each of which rises from the face's outer edge 36, defined by a straight segment joining its two upper vertices, at an angle 38 preferably of approximately thirteen degrees (13°).

Figure 2A:
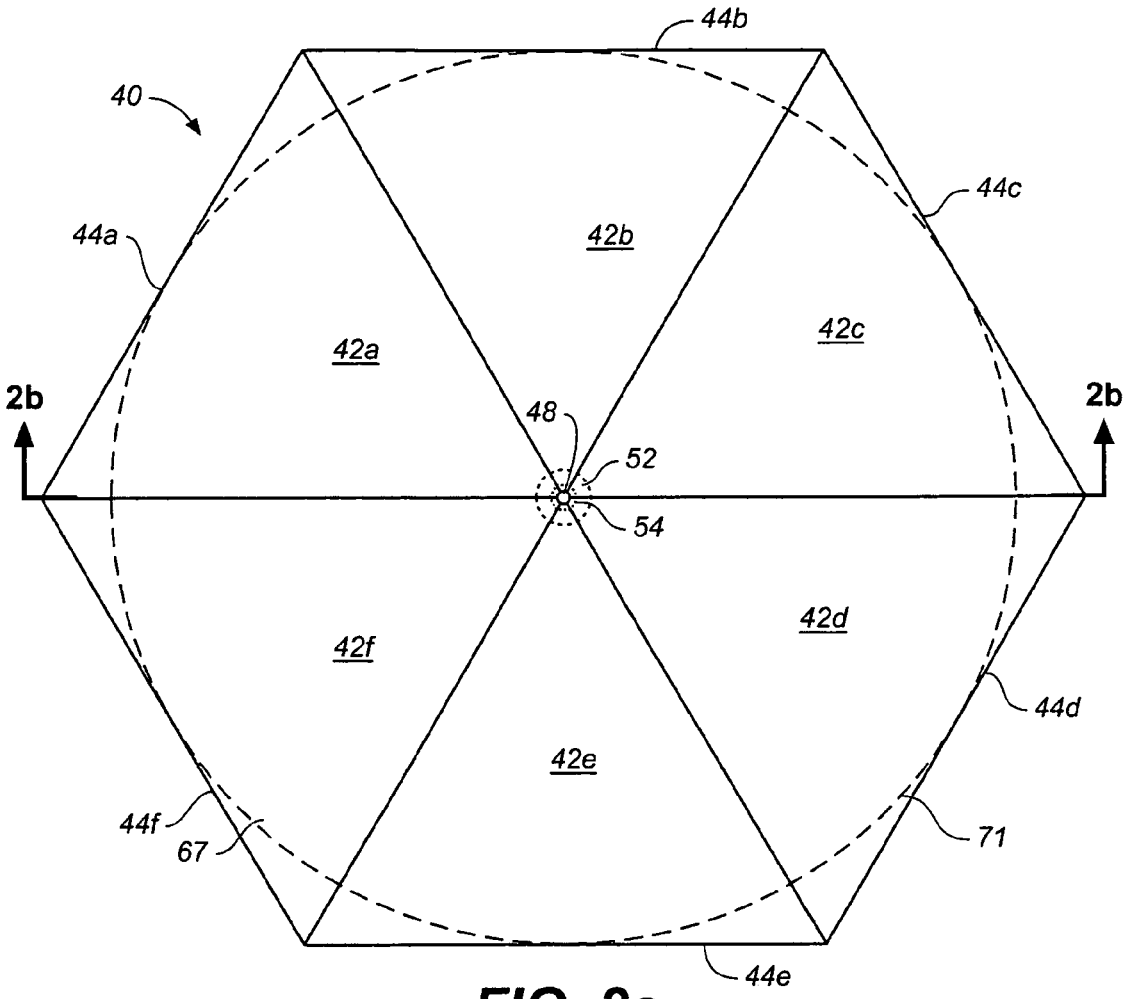
FIG. 2*a* is a top view of the strutless building module shown it in its hexagonal embodiment.
Figure 2B:
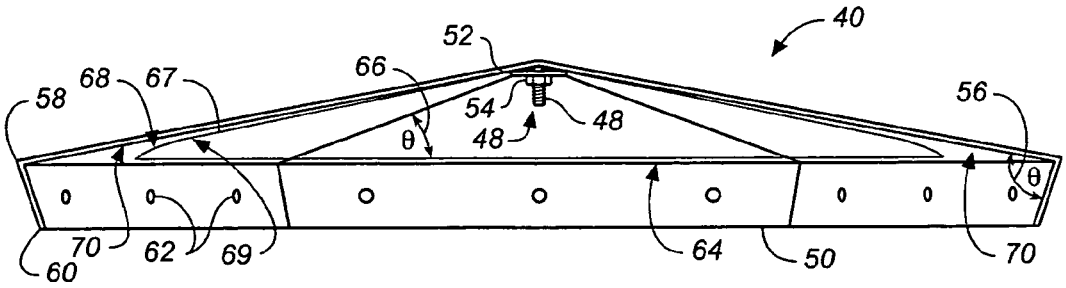
FIG. 2*b* is a side elevation cross-sectional view of the module of FIG. 2*a* viewed along the cutting plane indicated in FIG. 2*a;*

FIG. 2*a* is a top view of the strutless building module 40 shown it in its second preferred, hexagonal embodiment, and FIG. 2*b* is a side elevation cross-sectional view of the module of FIG. 2*a* viewed along the cutting plane indicated in FIG. 2*a*. The hexagonal embodiment has six faces, 42 *a* through 42*f*, and six sides, 44*a* through 44*f*. As in the first preferred embodiment, the hexagonal embodiment includes a center connector 46 positioned at the module center, the connector comprising an integral center connector bolt 48 depending downwardly when the module is laid flat on its interior edge 50, and a center connector washer 52 positioned over the center connector bolt and held in place by a conventional nut 54. Each of the six sides are substantially flat and depend downwardly from associated module faces at an approximate angle 56 of 69 degrees (69°), and adjoining module faces and sides again intersect in an upper vertex 58, and the corresponding adjoining sides intersect in a lower vertex 60. While 69° is the preferred angle, any angle within the range of 64° to 74° will provide an effective joint between adjoining modules. Each side also has a plurality of insertion holes 62 passing entirely through the module side.

As in the first preferred embodiment, the geometry of the second embodiment includes an elevated center, where the inclined planes of the module faces converge, each of the faces rising from the face's outer edge 64 at a preferred angle 66 of approximately thirteen degrees (13°), said outer edge defined by a straight segment joining the face's two upper vertices. Although 13° is the preferred angle for the faces, any angle ranging from 8° to 18° may work equally well.

FIGS. 2*a* and 2*b* also illustrate an optional disc 67, shown in phantom in FIG. 2*a*, said disc being substantially circular and concentric with center connector washer and similarly held in place by nut 54, said disc having a convex side 68 and a concave side 69, the former in approximation with the interior surface 70 of the module. The outer circumference 71 of the disc preferably engages the sides of the module. This disc can be employed to provide increased structural integrity to the module. Additionally, the disc can be employed to function as means for holding insulating material, wallboard, paneling, wall covering material, acoustic tiles or other sound attenuation material, and/or a combination of these or other materials between the convex side 68 of the disc and the interior surface 70 of the module. This provides the distinct advantage of effectively finishing the wall prior to installation, and therefore prior to having a wall or ceiling height. The disc may also be employed as a polarizing light filter when the modules are fabricated from materials suitably transparent for use in a greenhouse. Furthermore, the discs can be collectively motorized and synchronized to individually rotate as the sun passes overhead. In this fashion, the discs and modules can be orchestrated to provide a tightly controlled amount of sunlight into a greenhouse interior, and the growth of highly sensitive plant species can be enhanced.

Figure 3:
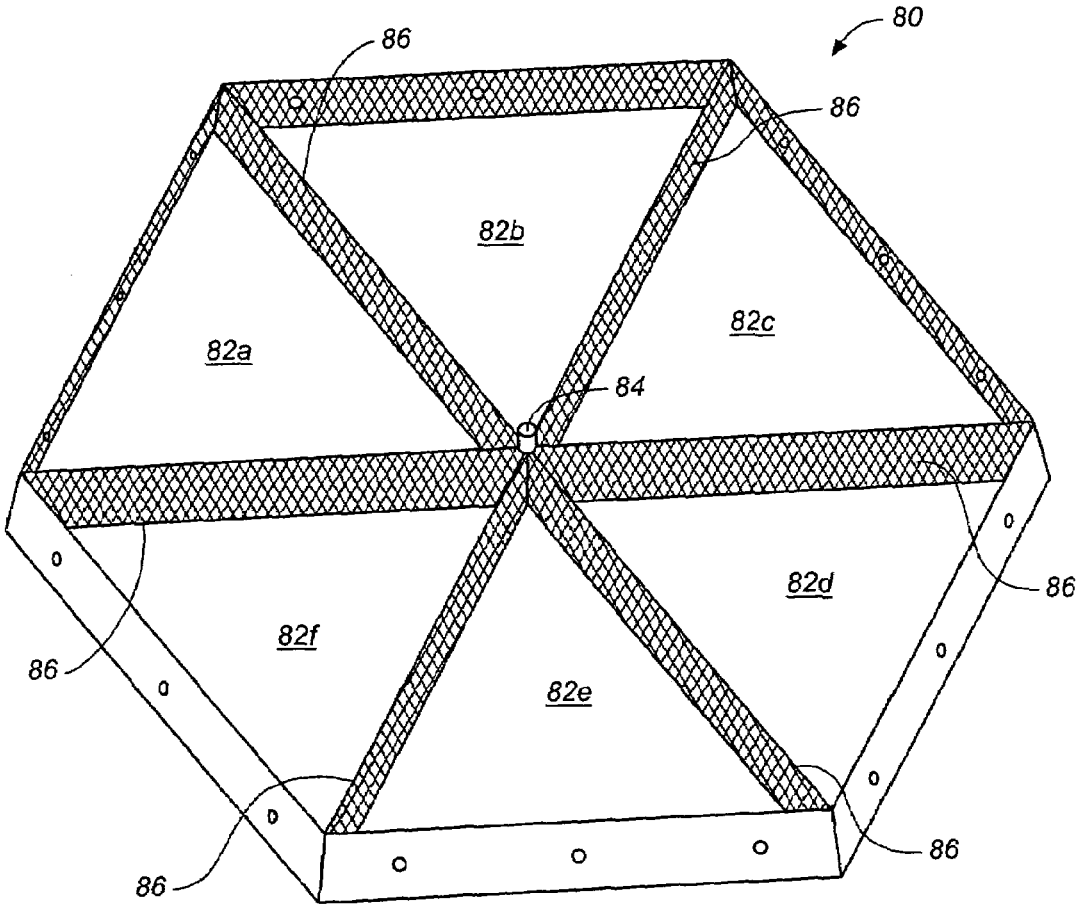
FIG. 3 is a perspective view of the module of FIGS. 2*a* and 2*b*, showing the interior side of the module faces and the center connecting bolt.

FIG. 3 is a perspective view of the module 80 of FIGS. 2*a* and 2*b*, showing the interior surfaces of the module faces 82*a* through 82*f*, and integral center connecting bolt 84. This view illustrates how the intersections of the module faces can be reinforced with spokes 86 comprised of laminated fabrication material. In the case of fiberglass, for example, the spokes may consist of a lay up of mat and resin. It will be readily appreciated that the specific manufacturing processes must be adapted to the materials used in fabrication.

Figure 4:
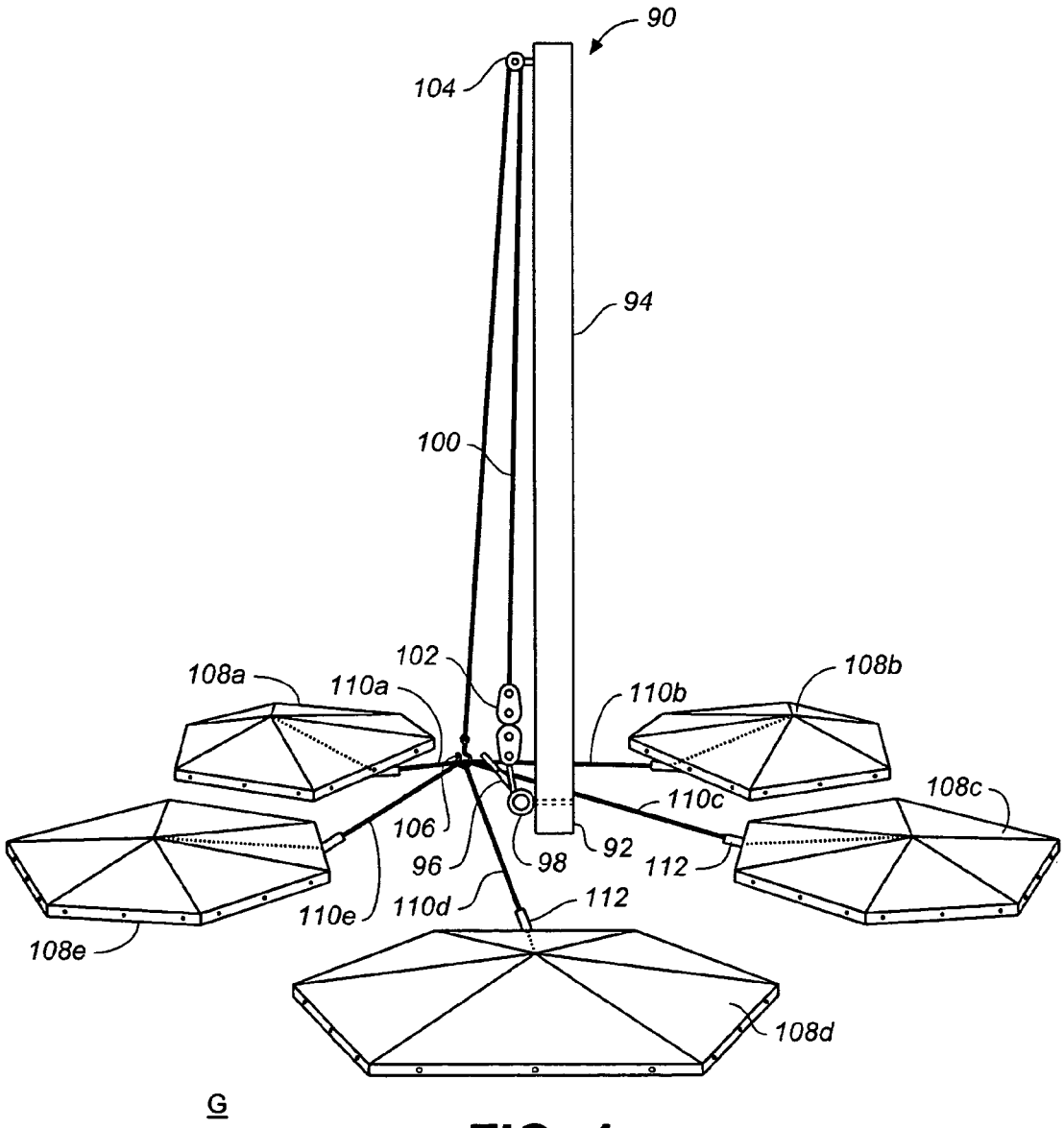
FIG. 4 is perspective view showing a first step in a method of assembling the inventive modules using a boom-free hoist.

FIG. 4 is a perspective view showing a first step in assembling the inventive modules using a boom-free hoist 90. Construction of a geodesic dome using either of the embodiments described herein consists of only a few simple steps. After fabrication of the strutless modules, the boom-free hoist is erected in a substantially vertical position such that its base 92 is located in the planned center of the dome structure. The hoist comprises a vertical support member 94, which may be sunk into the ground G, or otherwise supported with other support members. Near its base, the hoist includes a comealong, or ratchet winch 96, connected to the vertical support member with an eye bolt 98 passing through the vertical support member. A cable 100 connected to the winch at hook 102 passes upwardly to the upper end of the hoist and through a hoist pulley 104 connected to the vertical support member, after which it depends downwardly and terminates in a heavy hook 106.

Next, using the second preferred embodiment for purposes of illustration, an array of five modules, 108*a* through

108*e*, is positioned around the base of the hoist, and each of the modules is connected in the manner described above to form the uppermost section of the dome, excluding the topmost module. When thus connected, the modules form an upper course constituting a kind of skirt around the hoist. Five connection cables, 110*a* through 110*e*, are then assembled and the end of each cable is connected to the module center connector bolt of one of the modules and secured in place by the center connecting nut. The upper ends of the respective connection cables are connected at their respective upper ends to heavy hook 106. Preferably, rubber sleeves 112 are interposed between the upper and lower ends of the connection cables and positioned at the point where the cables rub the edges of the modules so that the cables do not cause damage to the modules as the dome is erected.

Figure 5:
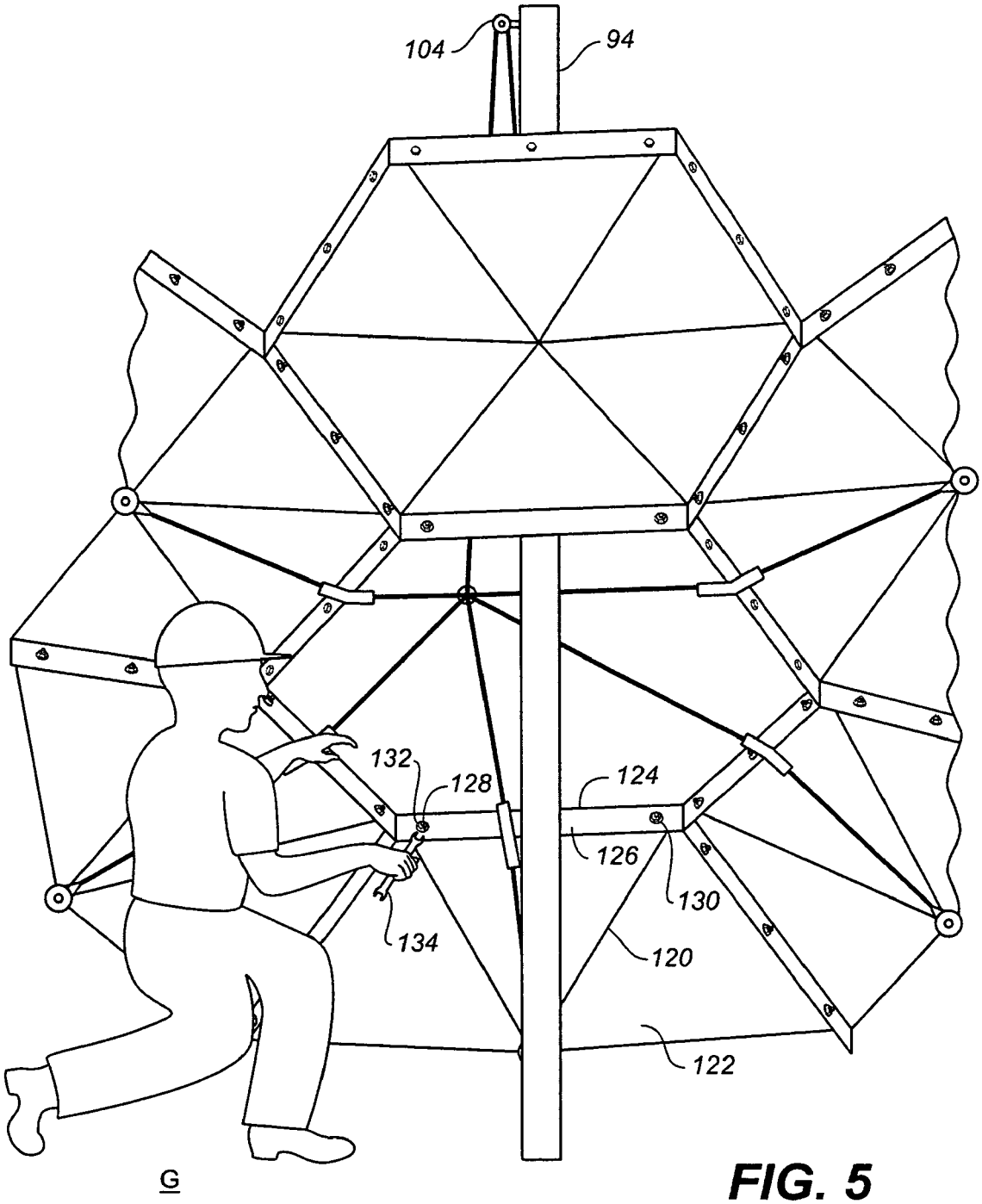
FIG. 5 depicts a workman connecting modules from underneath a first course or lift.

FIG. 5 is a perspective view showing a workman connecting modules from underneath the first lift, or course, assembled in the manner described above. This view particularly shows how the strutless modules are connected at their sides. This view highlights the simplicity and convenience of erecting a structure using the modules of the present invention. Specifically, a first module 120 is positioned in relation to an adjoining second module 122 such that the respective sides, 124 and 126, of each module are approximated and the insertion holes are aligned. Bolts 128 are then inserted through each hole, a washer 130 is placed over each bolt, and a nut 132 is then placed and tightened down onto each bolt using a conventional wrench 134.

An alternative means of connecting modules would entail the use of adhesive material. This would provide a relatively clean finish but would detract from the flexibility afforded by the nuts and bolts assembly. Additionally, it would make the structure essentially permanent. C-clamps, or some variation thereof, are also alternative fastening means. Rather than connecting the modules using nuts and bolts, the clamp member could simply be fitted over the edges of adjoining modules and tightly screwed down. While not as elegant as a bolted structure, this too would virtually eliminate the need for tools in the assembly process and would still provide for flexibility during construction and for easy disassembly after construction.

It is worth noting that the module of the present invention may be fabricated from any of a number of suitable materials, including, among others, wire-mesh reinforced concrete, fiberglass, and several lightweight plastics, including generally transparent plastics suitable for use in greenhouse structures. The geometry of the module lends itself to manufacture using a simple two part mold, making mass production of the modules not only possible, but economical and rapid.

Figure 6:
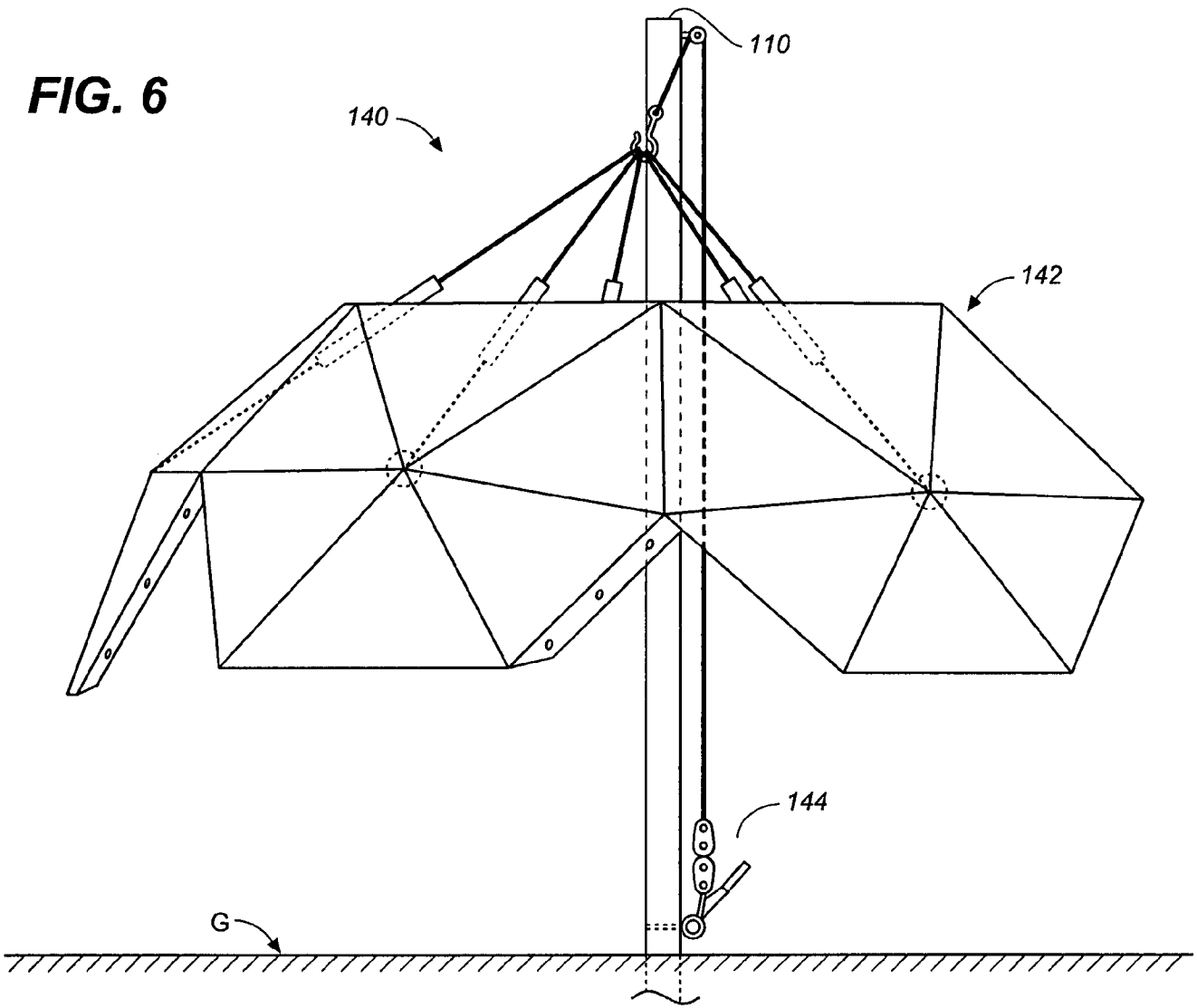
FIG. 6 illustrates the dome under construction, with a first lift elevated above ground.

After connecting the connection cables to the center connectors and the heavy hook, the winch is positively operated to elevate the uppermost dome section of modules above the ground. This first elevated stage 140 is illustrated in FIG. 6, showing a first lift 142 hoisted above the ground, G, and held in the elevated position by the winch and cable connecting assembly 144 described above. Construction then continues in courses, or lifts: the hoist is employed to raise the dome under construction to provide workers with a convenient and comfortable means to connect module after module to the lower sides of assembled modules. The lifts are repeated until the dome is constructed to the desired extent, commonly ½, ⅜, or ⅝ of sphere.

As will be readily appreciated, with few exceptions, the workers are always working safely on the ground and without any need of scaffolding, ladders, or a supporting framework. There is an absolute minimum of tools required in the construction. After erecting the boom-free hoist, a simple hand wrench is all that is required for construction. Furthermore, there are no complex construction techniques or skills required of the workers; little more than tightening bolts is entailed after positioning the hoist. This top-down construction has numerous advantages, not the least of which is that there is never any heavy lifting or transport of modules onto elevated work spaces. Besides the obvious safety advantages, the modules may be easily aligned and positioned for connection to the structure. In fact, the entire dome may be adjusted and repositioned at any point in construction before securing the dome to its base by pivoting or rotating the structure under the connecting cables. If, for some reason, it is decided that a precut door or window ought to face in a slightly different direction than was planned at the outset of construction, the dome's orientation can be substantially altered without any disassembly and reconstruction. This provides maximum flexibility and cuts down on the need to make unalterable decisions before commencing construction.

Figure 7:
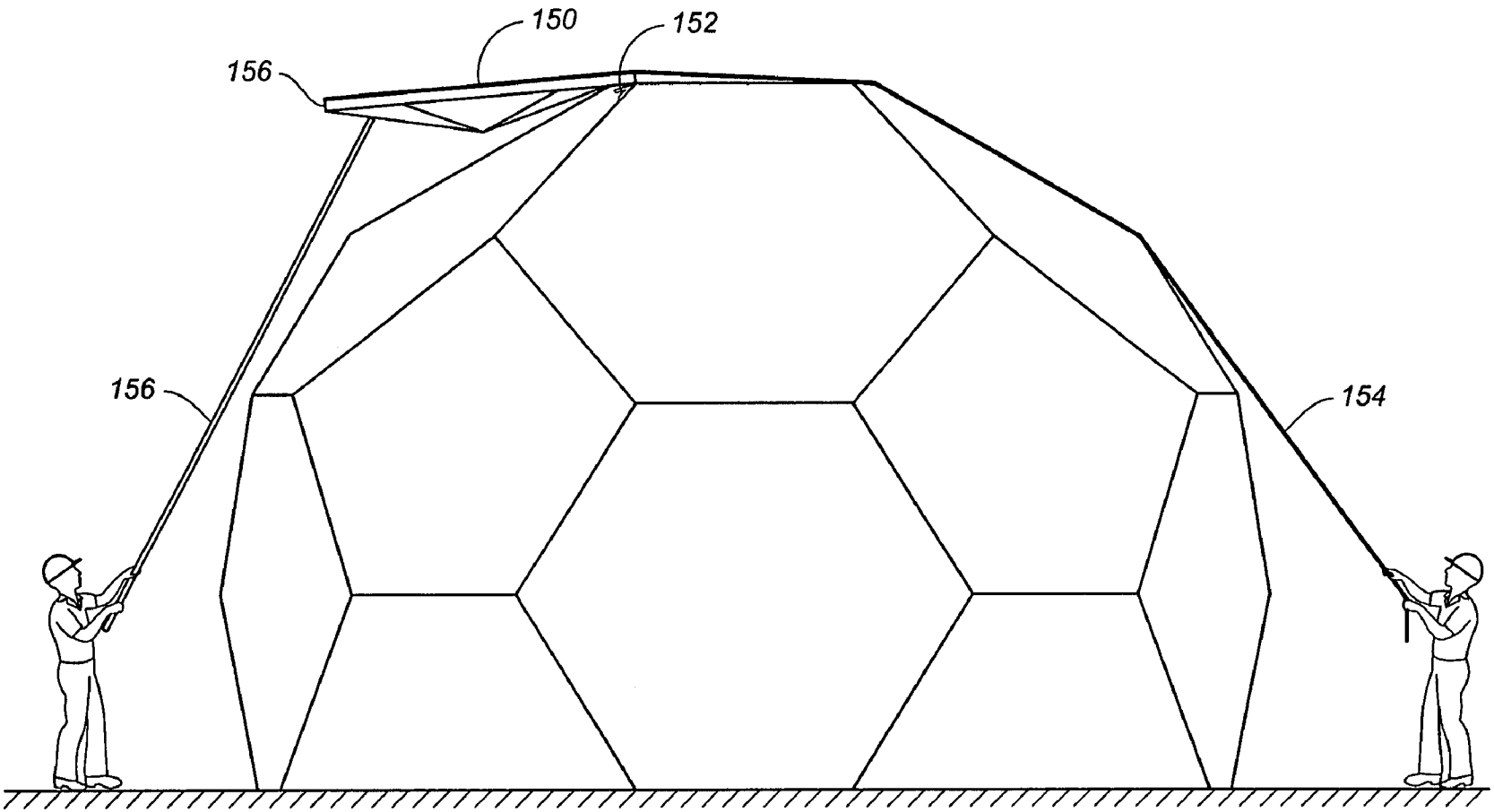
FIG. 7 is a side elevation view showing two means for attaching the top and final module when a top-down construction method is employed.

The boom-free hoist may be incorporated into the completed structure to function in a variety of ways. For example, it may simply be retained to provide support. Alternatively, or in addition, it may function as the primary vertical support for a spiral staircase or duct work. If an entirely open interior space is desired or required, the hoist may be removed. In the event the boom-free hoist is to be removed, provision must be made for connecting a final, uppermost module. Several options may be employed to connect the final module. As shown in FIG. 7, for small to medium sized domes, the top module 150 may be fastened by at least one hinge 152 to the first course before the course is elevated. The module is then left in an open position to leave the boom opening unobstructed. A tether 154 may then be connected to the module vertex or side directly opposite the hinge and after the boom is removed, it may be pulled to pivot to swing the module into its open hole, where it will simply drop in and settle perfectly into place. Alternatively, rather than using a tether, a simple extension pole 156 may be used to push the module so that it pivots on the hinge. In either case, the builder may connect the bolts for the final module either by using means well known in the art to work above ground, such as a ladder, scaffolding, or a cherry picker, or he or she may elect to fasten the bolts using tools connected to extension poles.

Figure 8:
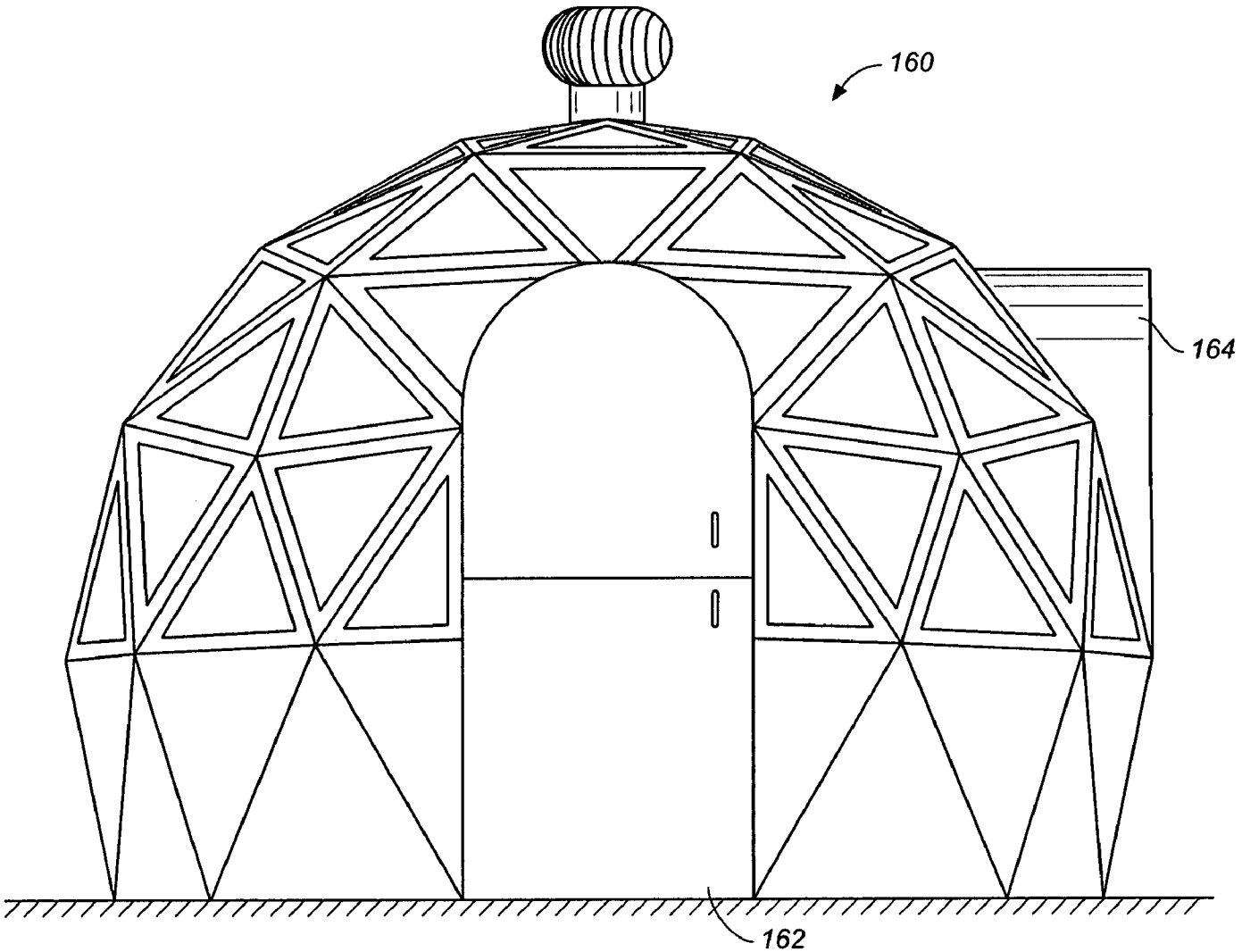
FIG. 8 is a view showing a dome constructed of the modules pentagonal modules of the present invention.

FIG. 8 is a view showing a dome constructed of the modules pentagonal modules of the present invention. This view illustrates a completed dome 160 having an arched doorway 162 and a window dormer 164. Such features may be incorporated by cutting openings and adding structure after assembly, or alternatively by precutting the modules and fitting them appropriately during assembly.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A top down method of assembling a modular domical structure, comprising the steps of:

(a) providing a plurality of strutless building modules, each of the modules comprising a polygonal member having a center and a center connector affixed to the center, and connection means for assembling a plurality of the polygonal members into a domical structure having an uppermost section and a lower portion;

(b) erecting a hoist in a substantially vertical position, the hoist having a base and having lifting means and a connecting cable with center connector attachment means for connecting to the center connectors of the polygonal members;

(c) assembling and connecting a plurality of polygonal members so as to form a first course of polygonal members around and encircling the base of the hoist, which will comprise the uppermost section of the domical structure;

(d) connecting the center connectors of at least two of the polygonal members forming the first course to the attachment means using the hoist connecting cable;

(e) elevating the first course in a balanced fashion using the hoist so as to present at least one side of the polygonal members of the first course at a convenient height to workmen on the ground;

(f) attaching a plurality of polygonal members to the elevated polygonal members of the first course so as to form a second course of polygonal members below the first course;

(g) elevating the entire dome structure under construction to again present at least one side of the polygonal members comprising the second course for attachment of further polygonal members to form further courses, if desired; and (h) repeating steps (f) and (g) for all subsequent courses until the domical structure is constructed to the desired extent.

2. The method of claim 1, wherein the step of providing polygonal members comprises the use of polygonal members having an exterior surface, an interior surface, a plurality of sides, a lower edge, and a plurality of inclined faces each one of which has an outer edge intersecting one of the sides and oriented so as to converge in a point at substantially the center of the polygonal member.

3. The method of claim 2, wherein the center connector comprises a center connecting bolt depending downwardly from the surface of the module when said module is laid flat on its lower edge.

4. The method of claim 1, wherein step (b) comprises providing and erecting a boom-free hoist having a vertical support member with an upper end and a base, a winch connected to the vertical support member near the base via connection means, a hoist pulley located proximate the upper end of the hoist, a cable operatively connected to the winch and passing upwardly through the hoist pulley and then downwardly where it terminates in a heavy hook.

5. The method of claim 1, wherein step (c) comprises assembling and connecting a plurality of polygonal members so as to form a first course of polygonal members around and encircling the base of the hoist, which first course will comprise the uppermost section of the domical structure, excluding the topmost module.

* * * * *